US008435053B1

(12) United States Patent
Lee

(10) Patent No.: US 8,435,053 B1
(45) Date of Patent: May 7, 2013

(54) CABLE CONNECTOR WITH AN OBLIQUE GROUND ADAPTER

(76) Inventor: Chun-Te Lee, Taichung (TW)

( * ) Notice: Subject to any disclaimer, the term of this patent is extended or adjusted under 35 U.S.C. 154(b) by 21 days.

(21) Appl. No.: 13/338,334

(22) Filed: Dec. 28, 2011

(51) Int. Cl.
*H01R 4/66* (2006.01)

(52) U.S. Cl.
USPC ..... 439/97; 439/811

(58) Field of Classification Search ..... 439/95–97, 439/469, 810–812
See application file for complete search history.

(56) References Cited

U.S. PATENT DOCUMENTS 3,539,977 A * 11/1970 Woertz ..... 439/811
7,090,514 B2 * 8/2006 Lu ..... 439/97
7,621,787 B2 * 11/2009 Lu ..... 439/811
7,909,623 B2 * 3/2011 Lee ..... 439/97
8,100,704 B1 * 1/2012 Wei ..... 439/97

* cited by examiner

*Primary Examiner* — Khiem Nguyen
(74) *Attorney, Agent, or Firm* — Ming Chow; Sinorica, LLC

(57) ABSTRACT

A cable connector with an oblique ground adapter includes a main body, a cable adapter and a ground adapter. The main body is formed with a vertical main plate and a side plate. The main plate has one side extended integrally with the side plate. The cable adapter secured on the main plate has an interior bored with a cable insert hole having a shaft line formed along a shaft center, longitudinally defined to have a perpendicular line to be intersected with the first shaft line. The ground adapter obliquely mounted on the side plate has an interior disposed with a threaded hole, having second shaft line formed along the shaft center of the threaded hole and slanting toward the perpendicular line to be intersected and formed with an acute angle, diminishing the breadth and volume of the side plate for lowering manufacturing cost of cable connectors.

6 Claims, 8 Drawing Sheets

CABLE CONNECTOR WITH AN OBLIQUE GROUND ADAPTER

BACKGROUND OF THE INVENTION

1. Field of the Invention

This invention relates to a cable connector, particularly to one provided with an oblique ground adapter.

2. Description of the Prior Art

Generally, many electric apparatuses make use of the transmission function of cable to carry out distant transmission for sounds and images with different frequencies, such as signal transmission of TV antennas, computer processing, internet connection and the like, and when a cable is drawn to a certain distance, the cable will be connected with a cable connector for facilitating the cable of next stag to be drawn and installed to a farther destination. A conventional cable connector, as shown in FIGS. 1-3, includes a main body 10, a cable adapter 20 and a ground adapter 30 combined together. The main body 10 is formed with a vertical main plate 11 and a side plate 12, which are extended integrally and positioned at the same level surface and have their lower sides respectively provided with a first locking portion 13 and a second locking portion 14 extending oppositely and transversely. The first locking portion 13 and the second locking portion 14 are respectively bored with a first locking hole 131 and a second locking hole 141 in the center for locking members 200 to be inserted therethrough to firmly lock the cable connector on a plane surface. The cable adapter 20 is transversely inserted and positioned at an upper section of the main plate 11 and has two transversely opposite ends respectively bored with a cable insert hole 21 and having their outer circumferential edges respectively provided with male threads 22 respectively to be threadably combined with the joints 301 of two cables 300. The ground adapter 30 is vertically bored with a threaded hole 31 having its lower side transversely disposed with a ground insert hole 32 for a ground conductive wire 400 to be transversely inserted therein, with a bolt 500 screwed into the threaded hole for tightly pressing and securing the ground conductive wire 400 in the ground insert hole 32.

However, in recent years, raw materials have fallen short and the price of metal around the globe rises higher and higher, especially the price of copper. Since the cable connector of this invention is generally made of copper, and the conventional cable connector has a portion from one side of the cable adapter 20, near the ground adapter 30, to the outer edge of the side plate 12 defined to have a first side plate breadth D1, and an interval (A) is further formed between the cable adapter 20 and the ground adapter 30 to increase the first side plate breadth D1, the cable connector is formed with a certain volume and as a result, the manufacturing cost of a cable connector always stay high. Therefore, how to diminish the volume of the conventional cable connector and lower the manufacturing cost of a cable connector is an important problem to be solved.

SUMMARY OF THE INVENTION

The objective of this invention is to offer a cable connector with an oblique ground adapter, able to diminish the breadth and the volume of a side plate for lowering manufacturing cost.

The cable connector with an oblique ground adapter in the present invention includes a main body formed with a vertical main plate and a side plate, and the vertical main plate has one side extended integrally with the side plate. A cable adapter is fixed on the main plate and provided with a cable insert hole in the interior. The side plate is mounted thereon with a ground adapter having its interior bored with a female threaded hole, the ground adapter formed with a transverse ground insert hole communicating with the female threaded hole, the ground insert hole is at the bottom of the female threaded hole. The cable adapter is formed with a first shaft line along the shaft center line of the cable insert hole and longitudinally defined to have a perpendicular line to be intersected with the first shaft line. The ground adapter is formed with a second shaft line along the shaft center line of the female threaded hole, and the ground adapter is obliquely set on the side plate, letting the second shaft line slanting downward toward the perpendicular line and intersected with the perpendicular line to form an acute included angle between the perpendicular line and the second shaft line.

BRIEF DESCRIPTION OF DRAWINGS

This invention will be better understood by referring to the accompanying drawings, wherein.

DETAILED DESCRIPTION OF THE PREFERRED EMBODIMENT

Since the members of a cable connector of the preferred embodiments in the present invention are the same as those disclosed in the prior art described above; therefore, the numbers of the members of this invention continue following the same numbers employed in the prior art.

Figure 4:
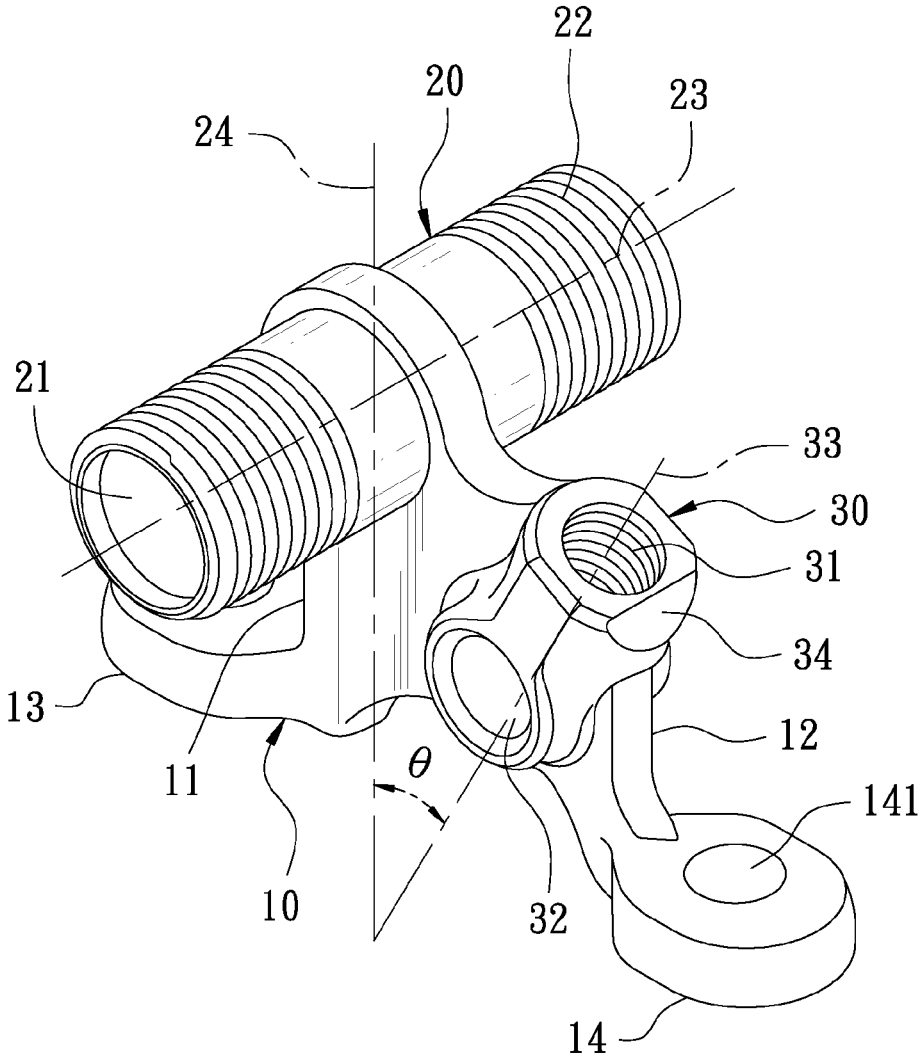
FIG. 4 is a perspective view of a first preferred embodiment of a cable connector in the present invention.
Figure 5:
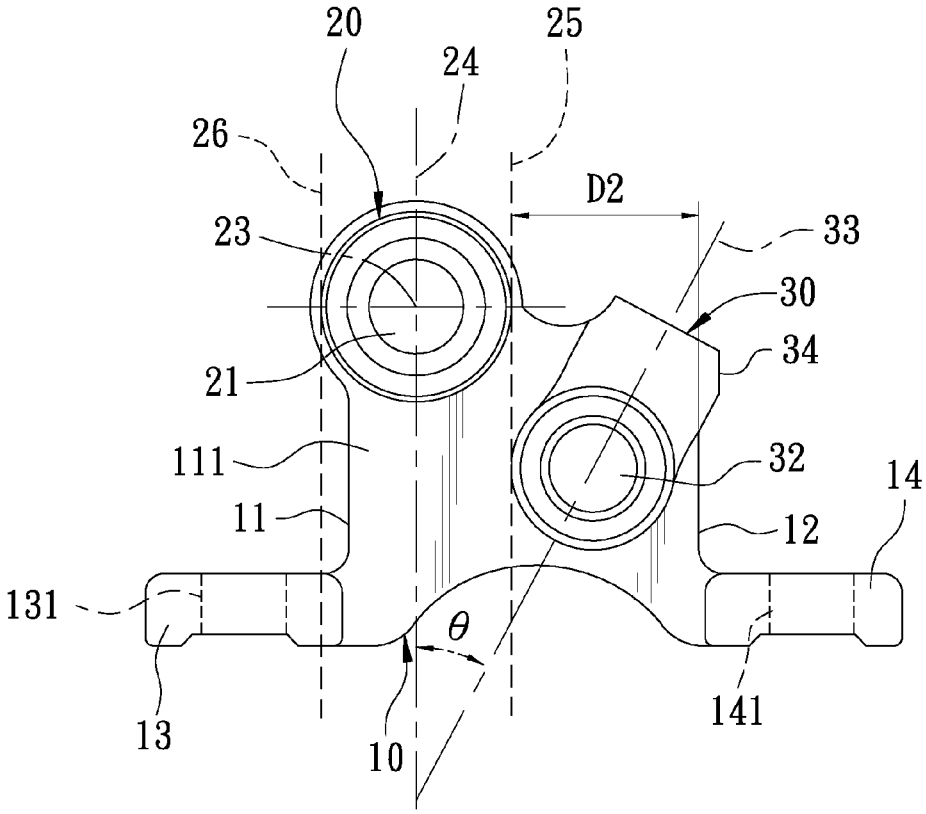
FIG. 5 is a side cross-sectional view of the first preferred embodiment of the cable connector in the present invention.

A first preferred embodiment of a cable connector with an oblique ground adapter in the present invention, as shown in FIGS. 4 and 5, includes a main body 10, a cable adapter 20 and a ground adapter 30 as main components combined together.

The main body 10 is formed with a vertical main plate 11 and a side plate 12 extended integrally and positioned at a same level surface. The main plate 11 and the side plate 12 are respectively extended transversely and formed with a first locking portion 13 and a second locking portion 14 facing each other and having their centers respectively bored with a first locking hole 131 and a second locking hole 141.

The cable adapter 20 transversely inserted through and positioned at an upper section of the main plate 11 is transversely bored with a cable insert hole and has the outer circumferential side of two transversely opposite ends respectively provided with male threads 22. Further, the cable adapter 20 is formed with a first shaft line 23 along the shaft center of the cable insert hole 21, and is longitudinally defined to have a perpendicular line 24 at an intermediate location, which vertically intersects the first shaft line 23. Furthermore, the cable adapter 20 is longitudinally defined to have a first tangent line 25 at an outer circumferential edge of one side near the side plate 12 and also vertically defined to have a second tangent line 26 at an outer circumferential edge of another side far away from the side plate 12, letting the main plate 11 form a coverage region 111 between the first tangent line 25 and the second tangent line 26.

The ground adapter 30 is obliquely mounted at an upper section of the side plate 12 and disposed with a female threaded hole 31 that is bored downward from the top side to the lower side of the ground adapter 30. The ground adapter 30 formed with a transverse ground insert hole 32 communicating with the female threaded hole 31, the ground insert hole 32 is at the bottom of the female threaded hole 31, the transverse ground insert hole 32 located beneath the cable adapter 20.

In addition, the ground adapter 30 is formed with a second shaft line 33 along the shaft center of the female threaded hole 31, and the second shaft line 33 and the perpendicular line 24 are at a same level surface. The second shaft line 33 slants downward toward and intersected with the perpendicular line 24 and formed with an acute included angle θ between them, with the range of the included angle θ being between 15 degrees to 40 degrees. In this preferred embodiment, the included angle θ is 28 degrees. Moreover, the main body 10 has a portion from the outer edge of the side plate 12 to the first tangent line 25 defined to be a second side plate width D2.

Figure 1:
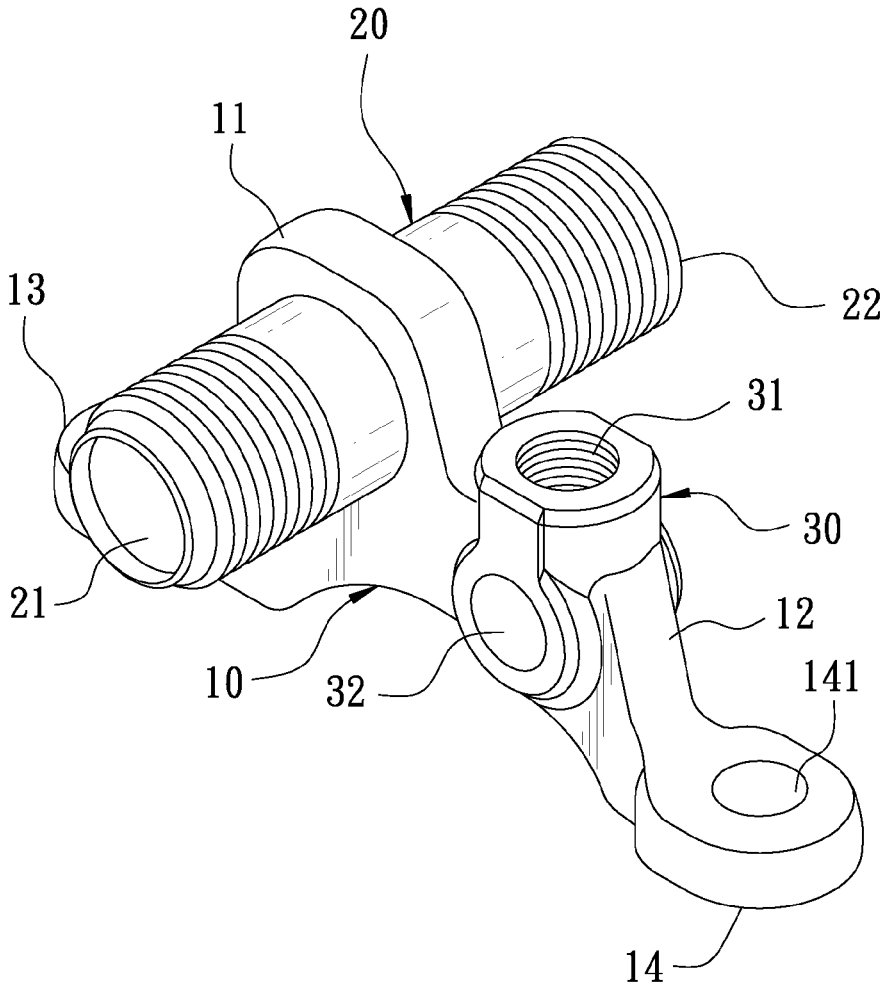
FIG. 1 PRIOR ART
FIG. 1 is a perspective view of a conventional cable connector.
Figure 2:
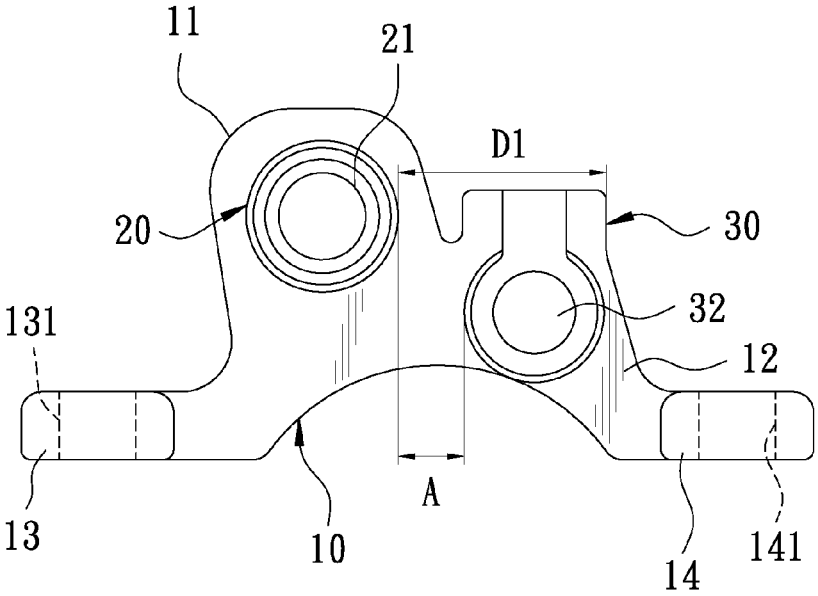
FIG. 2 PRIOR ART
FIG. 2 is a side cross-sectional view of the conventional cable connector.
Figure 3:
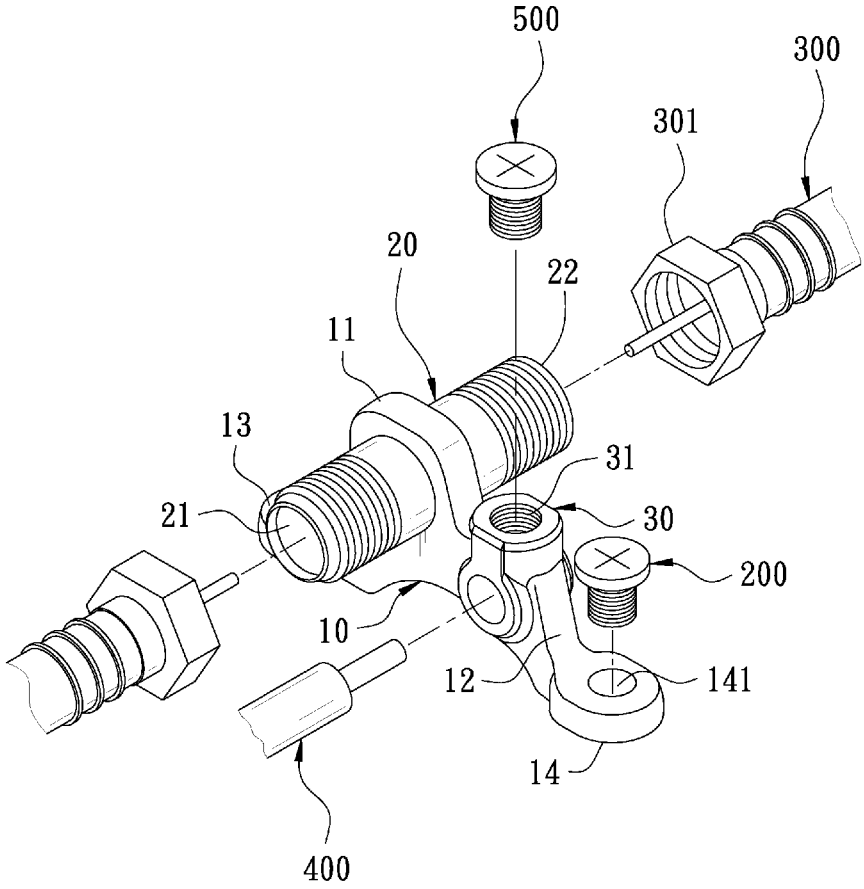
FIG. 3 PRIOR ART
FIG. 3 is an exploded perspective view of the conventional cable connector in a using condition.

Referring to FIGS. 4 and 5, since the ground adapter 30 of this invention is obliquely set on the side plate 12, the second shaft line 33 and the perpendicular line 24 are obliquely intersected and formed with an included angle θ; therefore, when the ground adapter 30 is shifted and positioned bias toward the cable adapter 20, the ground insert hole 32 of the ground adapter 30 having an outer circumferential edge, the circumferential edge of the ground insert hole 32 will touch the coverage region 111 to let the ground adapter 30 positioned closer to the cable adapter 20. Referring to FIG. 5 and FIG. 2, it can be found that in this preferred embodiment, the interval (A) between the cable adapter 20 and the ground adapter 30 is diminished than that in the conventional one, able to shorten the second side plate breadth D2 and lessen the volume of the side plate 12 and hence able to lower manufacturing cost of the cable connector.

One more special feature of this invention is that the upper circumferential edge of the ground adapter 30 is cut with a cut plane 34 for further diminishing the volume of the ground adapter 30, not only able to reduce metal volume of the cable connector but also decrease interference between tools and the ground adapter 30 when the tool (not shown) is operated to lock the locking member 200.

Figure 6:
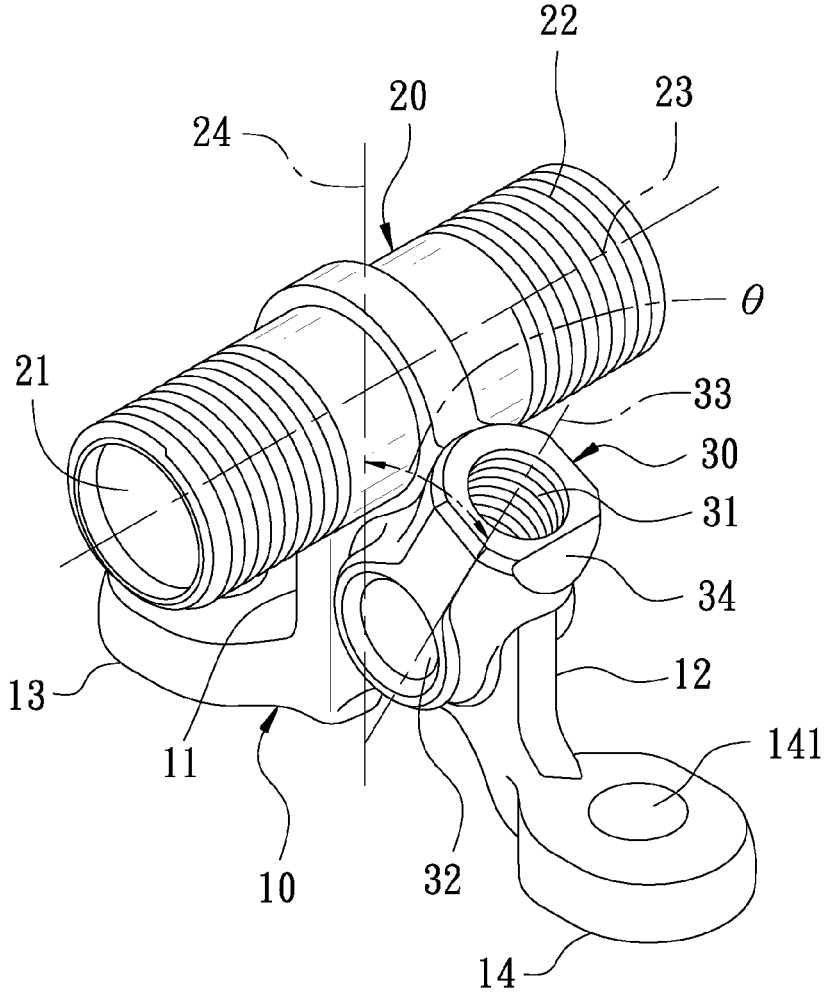
FIG. 6 is a perspective view of a second preferred embodiment of a cable connector in the present invention.
Figure 7:
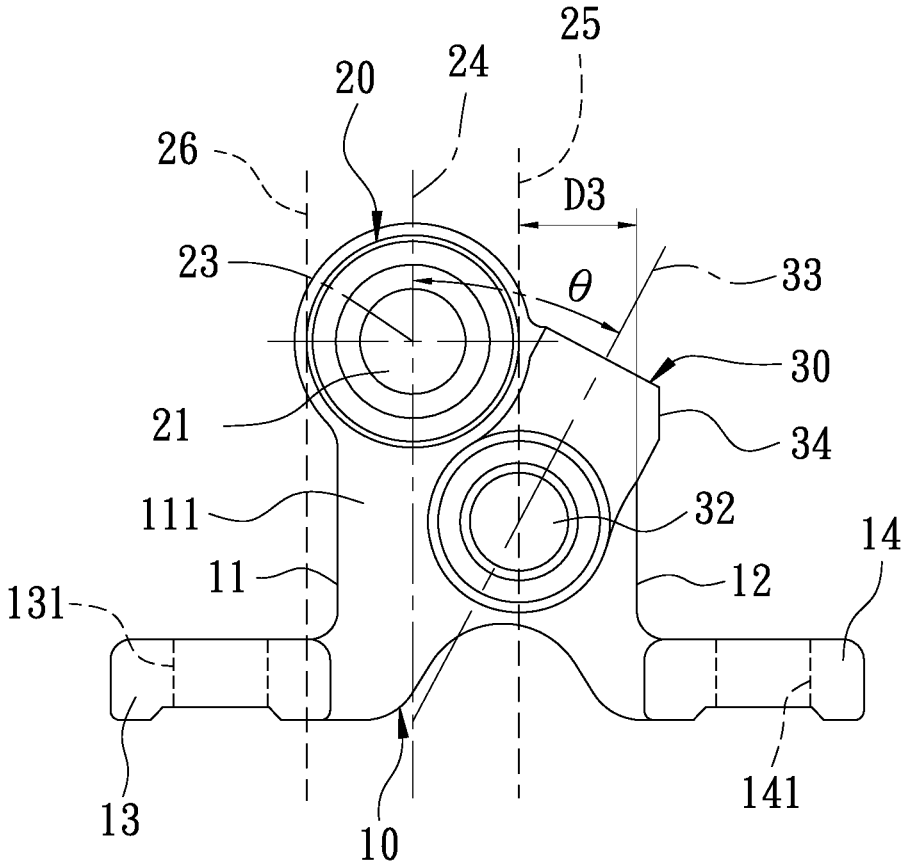
FIG. 7 is a side cross-sectional view of the second preferred embodiment of the cable connector in the present invention.

A second preferred embodiment of a cable connector with an oblique ground adapter in the present invention, as shown in FIGS. 6 and 7, is generally the same as the first preferred embodiment, except that the ground adapter 30 is shifted bias much closer to the cable adapter 20, and the ground insert hole 32 has its circumferential edge located in the coverage region 111 and further, the main body 10 has a portion from the outer edge of the side plate 12 to the first tangent line 25 defined to be a third side plate breadth D3 that is much smaller than the second side plate breadth D2. Thus, when the ground adapter 30 is shifted bias and positioned much closer to the cable adapter 20, the breadth and the volume of the side plate 12 can be further reduced for the purpose of lowering cost of the cable connector.

Figure 8:
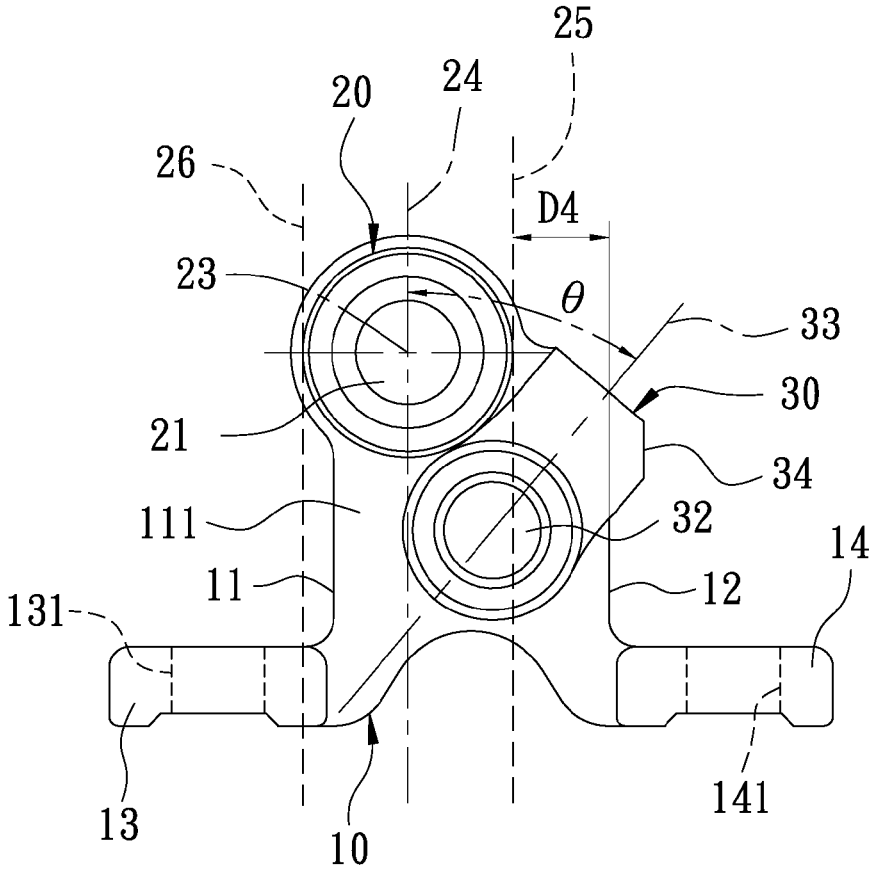
FIG. 8 is a side cross-sectional view of a third preferred embodiment of a cable connector in the present invention.

A third preferred embodiment of a cable connector with an oblique ground adapter in the present invention, as shown in FIG. 8, is almost the same as the second preferred embodiment, except that the included angle θ is 40 degrees. When the included angle θ is enlarged, the ground adapter 30 will be obliquely positioned much closer to the cable adapter 20, and the main body 10 has the portion from the outer edge of the side plate 12 to the first tangent line 25 defined to be a fourth side plate breadth D4 that is much smaller than the third side plate breadth D3, able to further lessen the width and the volume of the side plate 12.

While the preferred embodiments of the invention have been described above, it will be recognized and understood that various modifications may be made therein and the appended claims are intended to cover all such modifications that may fall within the spirit and scope of the invention.

What is claimed is:

1. A cable connector with an oblique ground adapter comprising a main body, said main body formed with a vertical main plate and a side plate, said main plate having one side extended integrally with said side plate, said main plate and said side plate respectively and oppositely provided with a transverse locking portion opposite to each other, said locking portions respectively bored with a locking hole in the center, said main plate provided thereon with a cable adapter, said cable adapter having interior transversely bored with a cable insert hole, said side plate mounted thereon with a ground adapter, said ground adapter having interior disposed with a female threaded hole, said ground adapter formed with a transverse ground insert hole communicating with said female threaded hole, said ground insert hole is at the bottom of said female threaded hole; and characterized by, said cable adapter formed with a first shaft line along a shaft center of said cable insert hole, said cable adapter longitudinally defined to have a perpendicular line, said perpendicular line intersected with said first shaft line, said ground adapter formed with a second shaft line along a shaft center of said female threaded hole, said ground adapter obliquely mounted on said side plate, letting said second shaft line obliquely extending downward toward said perpendicular line and intersected with said perpendicular line, an acute included angle formed between said perpendicular line and said second shaft line.

2. The cable connector with an oblique ground adapter as claimed in claim 1, wherein said cable adapter has two opposite sides of an outer circumferential edge respectively and longitudinally defined to have a first tangent line and a second tangent line, and a coverage region is formed between said first tangent line and said second tangent line of said main plate, said ground insert hole of said ground adapter having an outer circumferential edge touching said coverage region of said main plate.

3. The cable connector with an oblique ground adapter as claimed in claim 1, wherein said cable connector has two opposite sides of an outer circumferential edge respectively and longitudinally defined to have a first tangent line and a second tangent line, and a coverage region is formed between said first tangent line and said second tangent line of said main plate, said ground insert hole of said ground adapter having an outer circumferential edge located in said coverage region of said main plate.

4. The cable connector with an oblique ground adapter as claimed in claim 1, wherein said included angle is between 15 degrees and 40 degrees.

5. The cable connector with an oblique ground adapter as claimed in claim 4, wherein said included angle is 28 degrees.

6. The cable connector with an oblique ground adapter as claimed in claim 1, wherein said ground insert hole is located beneath said cable adapter.

* * * * *